US006153051A

United States Patent [19]

Tsai

[11] Patent Number: 6,153,051

[45] **Date of Patent: *Nov. 28, 2000**

[54] METHOD OF BLEACHING KRAFT PULP EMPLOYING CHLORINE DIOXIDE/ CHLORINE-OZONE BLEACH SEQUENCE

[75] Inventor: Ted Yuan Tsai, Harriman, N.Y.

[73] Assignee: International Paper Company, Tuxedo, N.Y.

[ * ] Notice: This patent is subject to a terminal disclaimer.

[21] Appl. No.: 07/871,401

[22] Filed: Jun. 25, 1992

Related U.S. Application Data

[63] Continuation of application No. 07/567,409, Aug. 14, 1990, abandoned, which is a continuation-in-part of application No. 07/348,606, May 5, 1989, Pat. No. 4,959,124.

[51] Int. Cl.[7] ..... D21C 9/14; D21C 9/153

[52] U.S. Cl. ..... 162/65; 162/78; 162/89

[58] Field of Search ..... 162/65, 87, 88, 162/89, 74, 67, 78

[56] References Cited

U.S. PATENT DOCUMENTS

| | | | |
|---|---|---|---|
| 396,325 | 1/1889 | Brin et al. . | |
| 1,957,937 | 5/1934 | Campbell et al. | 162/65 |
| 4,216,054 | 8/1980 | Bentvelzen et al. | 162/65 |
| 4,229,252 | 10/1980 | Meredith | 162/65 |
| 4,259,149 | 3/1981 | Jaszka et al. | 462/29 |
| 4,451,567 | 5/1984 | Ishibashi et al. | 435/170 |
| 4,543,155 | 9/1985 | Stawicki | 162/57 |
| 4,622,101 | 11/1986 | Hull et al. | 162/65 |
| 4,959,124 | 9/1990 | Tsai | 162/65 |

OTHER PUBLICATIONS

Berry et al, "Toward Preventing The Formation of Dioxins During Chemical Pulp Bleaching," *Pulp & Paper Canada*, p 48–58, Aug. 1989.

Kringstad et al, "Bleaching & The Environment", Jun. 1988, *1988 Int. Pulp & Bleaching Conf*, Orlando, Fl. p. 63–68.

Lachenal, D. and M. Bokstrom, M., "Improvement of Ozone Prebleaching of Kraft Pulps", Journal of Pulp and Paper Science, vol. 12, No. 2, Mar., 1986.

Germgard, U. and Birger Sjogren, "Ozone Prebleaching of a Modified–cooked and Oxygen–bleached Softwood Kraft Pulp", Svensk Paperstidning No. 15/1985.

Liebergott, et al, "Bleaching a Softwood Kraft Pulp Without Chlorine Compounds", TAPPI Jornal 67 (8) 76, Aug., 1984.

Granum, et al., "Influence of Bleaching Chemicals and Sequences on Some Properties of Sulphite Pulps", Journal of Pulp & Paper Science, pp. J25–J29 (162–65B).

Technical News, PT, Dec./Jan. 1989, p. 36 (162–87).

*Primary Examiner*—Steve Alvo

*Attorney, Agent, or Firm*—Luedeka, Neely & Graham, P C

[57] ABSTRACT

A method for improving the preparation of chemical cellulosic wood pulp for use in papermaking, and specifically to enhancement of the quality of a kraft pulp which has been subjected to a chlorine dioxide/chlorine bleaching stage and thereafter subjected to ozonation prior to an extraction stage in the bleaching sequence. The improved pulp of the present invention exhibits reduced total organically bound chlorine residues in the wood pulp and adsorbed organic halides (AOX) in the effluent, and has good brightness and viscosity. The advantages of the present invention may be accomplished by means of a bleaching sequence that employs a minimum of stages, namely (D→C)ZED or $D_c$ZED with attendant relatively lower capital investment than heretofore possible.

7 Claims, 5 Drawing Sheets

METHOD OF BLEACHING KRAFT PULP EMPLOYING CHLORINE DIOXIDE/ CHLORINE-OZONE BLEACH SEQUENCE

This is a continuation division of application Ser. No. 07/567,409, filed Aug. 14, 1990, now abandoned, which is a Continuation-in-part application of Ser. No. 07/348,606, filed May 5, 1989 now U.S. Pat. No. 4,959,124.

FIELD OF THE INVENTION

The present invention relates to delignification and bleaching of chemical cellulosic wood pulp fibers for use in papermaking and to the production of a pulp having reduced halogen concentrations, and good brightness and viscosity.

BACKGROUND OF THE INVENTION

Chlorine-based chemicals, such as chlorine, chlorine dioxide, and hypochlorite, have been used in pulp bleaching for several decades, and continue to be used for removing lignin and bleaching the pulp to high brightness. In general terms, the extent of bleaching, hence the degree of brightness obtained, is determined by the type of pulp being bleached and the proposed end use of the paper product. For example, kraft pulps intended for use in making fine writing papers require different bleaching circumstances which will produce the desired brightness in the final paper product. In all instances, however, where chlorine-based bleaching agents have been employed in the prior art, there are produced chlorinated organics and organic halogens (i.e. chlorides). The compounds are generally insoluble in an aqueous medium and substantial quantities are swept from the pulp with the effluent from one or more of the stages of the bleaching sequence. A relatively smaller percentage of such chlorinated organics and organic chlorides remain in the pulp and eventually appear in the paper product.

In chlorine-based bleaching processes, the "C" factor of the pulp is employed as a measure of the chlorination charge required for a specific pulp. By definition, the "C" factor refers to the effective chlorination charge and is equal to the chlorine dioxide plus the chlorine in the charge (expressed in terms of effective chlorine), divided by the Kappa number of the pulp. Generally, it is stated in the prior art that higher "C" factors produce brighter pulps, but that a "C" factor of 0.22 provides maximum brightness in a pulp without unacceptable degradation of the cellulosic fibers (e.g. reduced strength). Thus, it has been common heretofore when seeking maximum brightness of the pulp, (in the range of 70–85% GE) to use large "C" factors, i.e. larger quantities of chlorine-containing bleaching agent. Invariably such quantities of chlorine result in presently undesirable or unacceptable levels of chlorinated organics and/or organic chlorides.

In the past decade, there has been a growing concern about the environmental impact of chlorinated organic compounds in bleach plant effluent. Also, public concern for the disposal of paper containing organically bound chloride has been increasing. Undesirable chlorinated organics such as dioxin have been detected in the exhaust gases of incinerators burning municipal wastes containing chloride, including, for example, paper products made from chlorine bleached pulps. West German environmental regulations, for example, propose restricting the total chloride residue for packaging material including wood pulp to less than 200 ppm. The allowable adsorbed organic halogens (AOX) discharged in the effluent per ton of wood pulp are proposed to be restricted to 2.0 kg or less in some of the European countries. More stringent regulations are expected in the near future.

Several options have been proposed or practiced to reduce or eliminate chlorinated organics in the bleaching process. The most straightforward method is to substitute non-chlorine bleaching chemicals, such as oxygen, peroxides, ozone, peracetic acid, etc. for chlorine-based bleaching chemicals. Unfortunately, no chlorine-free bleaching process has been developed with the ability to produce acceptable pulp properties (such as brightness or viscosity) at an acceptable bleaching cost.

Another option to reduce the discharge of chlorinated organic compounds is to reduce the chlorine usage in the first stage of the bleaching process. Two alternatives that produce no significant degradation of pulp properties have been commercialized for this purpose. These are (a) extended delignification in the cooking stage and (b) oxygen delignification. These alternatives, with proper extraction, reduce the lignin content of brown stock going into the bleach plant. They do not, however, reduce the chlorinated organic compounds in the bleached pulp and effluent to sufficiently low levels.

A third option to reduce the generation of chlorinated organics in a bleaching process is to substitute chlorine dioxide for chlorine. Chlorine dioxide is a relatively strong oxidant compared to chlorine; to achieve the same degree of delignification, it requires only about thirty-eight weight percent chlorine dioxide on the pulp compared with one hundred weight percent of chlorine. However, these prior art processes are of the DEDED type wherein the chlorination stage (D) is followed by the conventional extraction (E) and additional chlorination (D) stages. The pulp and the discharge effluents resulting from this prior art option contain higher concentrations of chlorinated organics than are acceptable and/or desirable. Processes using both oxygen delignification and chlorine dioxide substitution have been suggested but do not achieve the regulated concentrations of chlorine-containing residues in either the pulp or the effluent.

SUMMARY OF THE INVENTION

In accordance with the method of the present invention, a chemical cellulosic wood pulp, e.g. a kraft pulp, is initially contacted with chlorine dioxide as the first-stage of a bleaching sequence. This chlorine dioxide may initially contain up to about 50% chlorine, based on effective chlorine, or in this initial bleaching stage, up to about 50% chlorine may be added to the chlorine dioxide as a substitute for the chlorine dioxide, also based on effective chlorine. Contrary to the prior art, after this initial D stage and prior to any extraction (E) stage, the pulp is processed through an ozonation stage. After the ozonation stage, the pulp is processed through the customary extraction, further bleaching, etc. stages. Importantly, and as noted to be contrary to the prior art, the ozonation takes place immediately following chlorination and prior to extraction. It has been recognized heretofore that ozone as a strong oxidant tends to degrade the pulp. Also, the art teaches that any use of ozone on pulp should be preceded with an acid wash, for example to remove heavy metals known to be harmful to the stability of ozone and/or decomposition products that may cause low pulp properties (e.g. strength). Contrary to such prior art, the present inventor has found that the ozonation can take place immediately following an initial chlorine dioxide/chlorine ($D_c$) bleaching stage as defined hereinabove. In this regard, it is to be understood that preferably there is a conventional water washing of the pulp between the stages of the bleaching sequence. This washing is not deemed to be a "stage", but rather is in the nature of a dilution of the aqueous phase of the pulp. For example, the quantity of water commonly used provides a dilution factor of between about 1 and about 3. It has been found that the wash water need not be "clean" or "fresh" water. For example, recirculated water which contains considerable residues from previous usage has been used successfully.

Among the several unexpected advantages provided by the present method, it has been found that the ozone treatment not only provides delignification and bleaching but also oxidizes substantial quantities of the chlorinated lignin residues left over from the chlorination stage. This oxidative activity converts substantial quantities of the insoluble chlorinated organics to inorganic chlorine-containing compounds and/or to chlorinated organics that are soluble in the acid liquor present in the ozonation stage. The oxidation of these chlorinated residues by the ozone thus not only reduces the chlorinated organic content in the wood pulp, but also reduces the adsorbed chlorinated organics discharged in the effluent. These converted inorganic chlorides, generally, are not environmentally hazardous and/or are recoverable. The result is a pulp having good brightness, acceptable viscosity, and reduced chlorinated organic content. Notably, such desirable results are obtained by employing as few as four stages in the bleaching sequence, and employing lower total effective chlorine charges in the chlorination stage than heretofore known to be possible.

Specifically, the present inventors, using their improved method, have produced wood pulp which has less than 200 ppm total organic chloride (TOCl) residue. TOCl as used herein refers to the total organically bound chlorine content of the pulp resulting from the bleaching sequence unless indicated otherwise. TOCl is essentially insoluble. The effluent discharge from the bleaching process of the disclosed method has less than 2.0 kg adsorbed organic halogens (AOX) per ton of wood pulp. AOX, as the term is used herein refers to the sum of the AOX, i.e. adsorbed organic halogens, of the several stages of bleaching, i.e. AOX of the $D_c$ stage plus AOX of the Z stage plus AOX of the E stage and plus AOX of further D stages, unless indicated otherwise. As noted, the pulp produced by the present invention has a brightness and viscosity that meet or exceed the requirements of industrial papermaking.

Therefore, it is an object of the present invention to provide a method for the preparation of kraft cellulosic wood pulp fibers for use in papermaking that can provide wood pulps with lowered residual chlorine content and effluents with lowered levels of adsorbed organic halides (AOX) while retaining or enhancing the characteristics of brightness and pulp viscosity within acceptable ranges.

It is another object of the present invention to provide such an improved method for bleaching kraft cellulosic pulp that is both economical and readily adaptable to the current papermaking industry. These and other objects will be recognized from the present description including the Figures.

Figure 1:
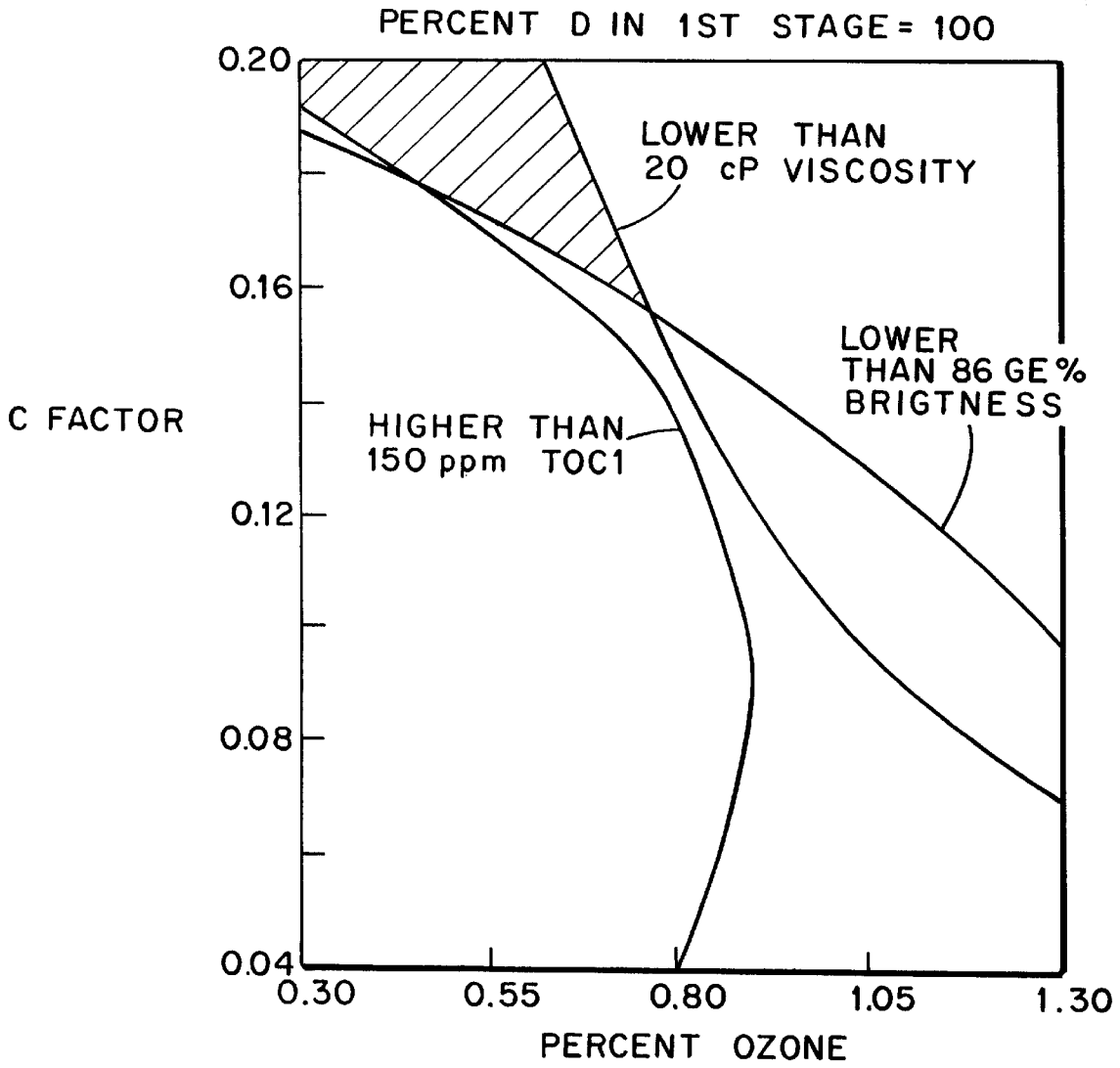
FIGS. 1–5 are graphic representations, computer-generated from mathematical models depicting the relationship of ozone charge and chlorination factor in obtaining various values of the brightness, viscosity and total chloride on pulp.
Figure 2:
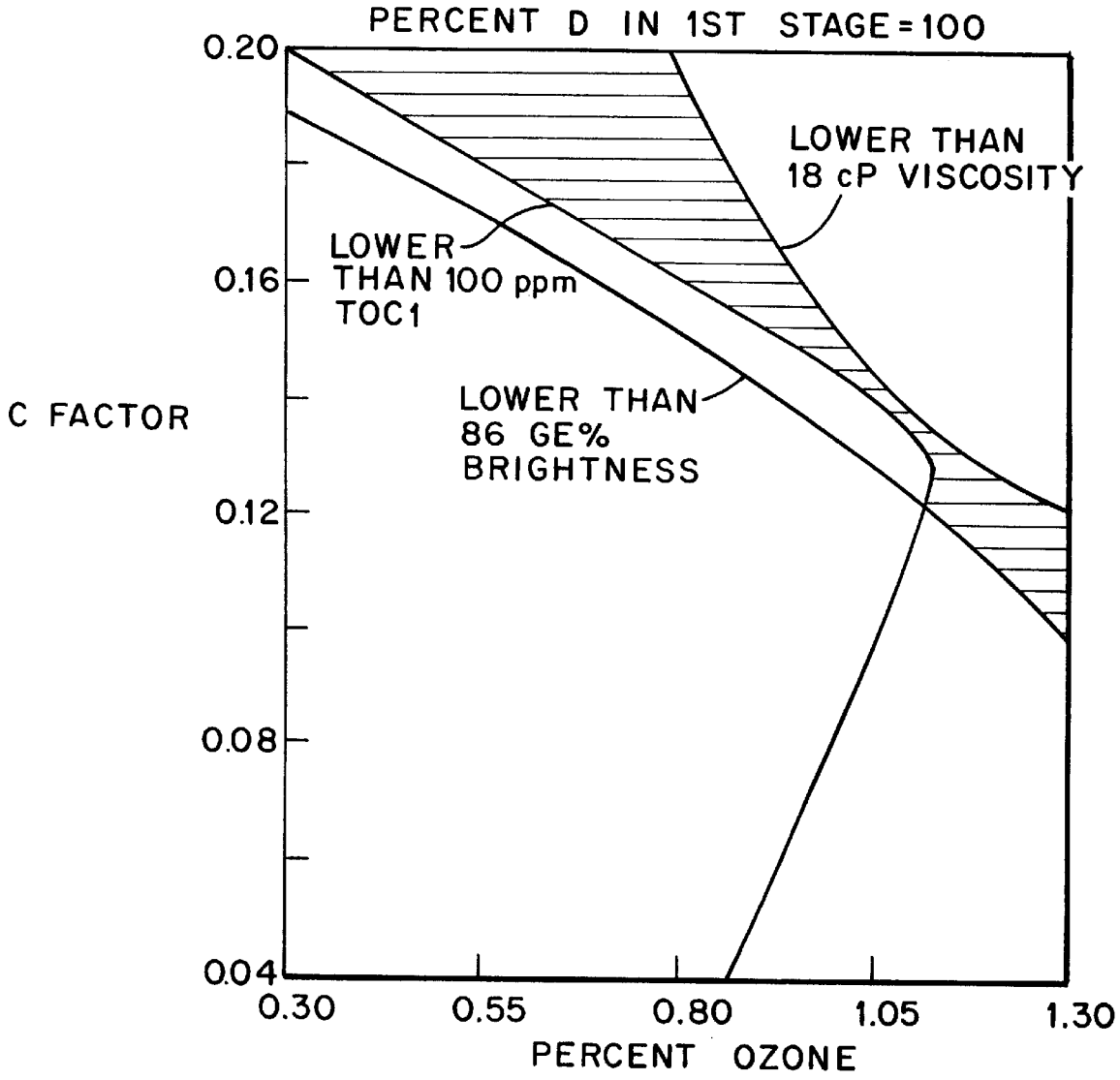
Figure 3:
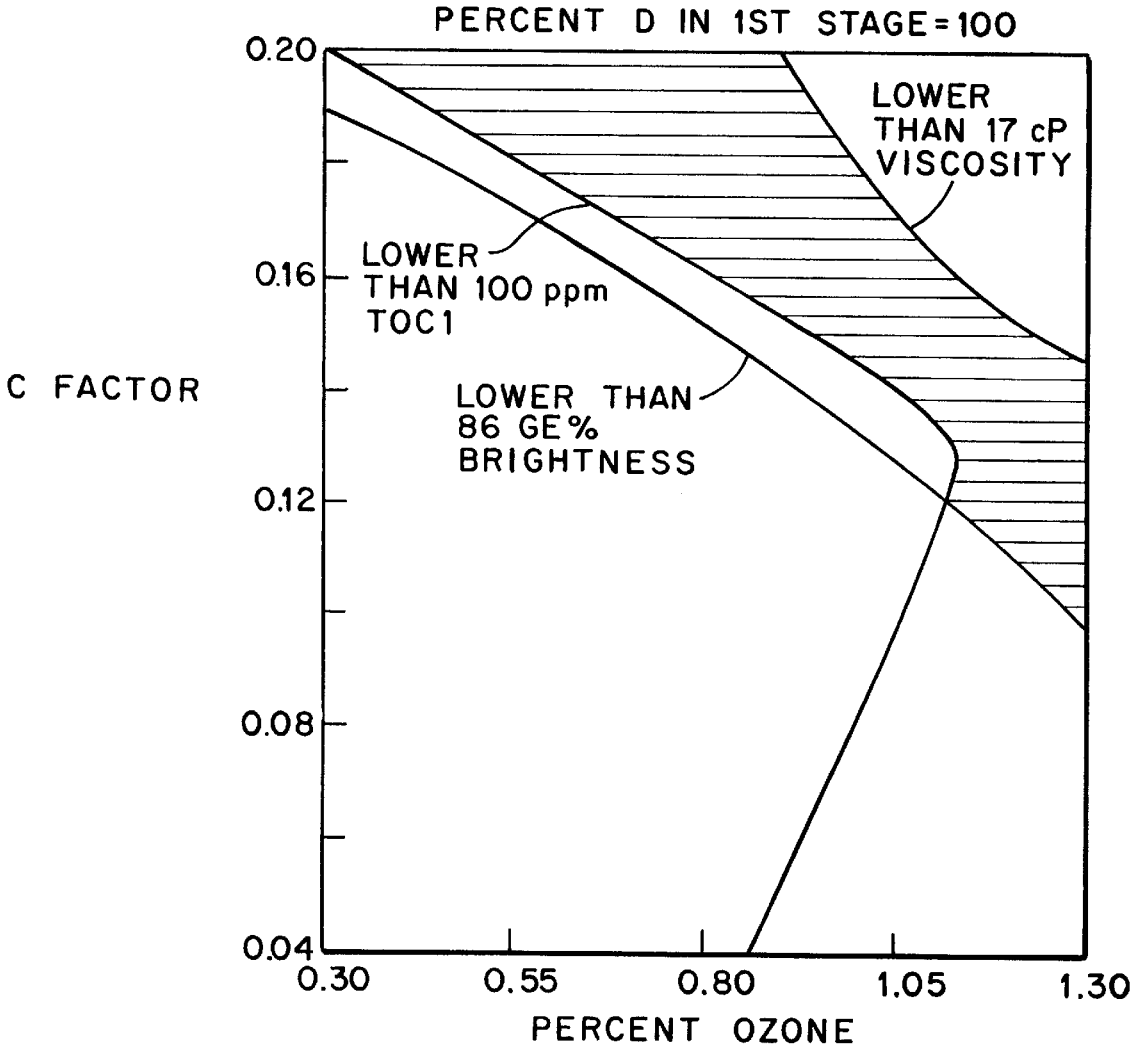

In accordance with the present invention, an aqueous slurry of cellulosic wood fibers as is commonly produced by conventional digestion means in the papermaking industry is processed through sequential stages of a bleaching operation. Softwoods, hardwoods or mixtures thereof may be processed employing the present invention. Following digestion, the slurry preferably is processed directly to the bleaching sequence disclosed herein. If desired, it may be subjected to such treatment as oxygenation, ozonation or other oxidation prior to entering the present sequence, but with attendant increased expense.

In the first stage of the present sequence, the pulp slurry is treated with a chlorine-based agent, i.e. chlorine dioxide or a mixture of chlorine dioxide and chlorine. Preferably in this stage the oxidant is principally chlorine dioxide, and the chlorination or "C" factor is preferably from about 0.04 to about 0.2. Consistent with the industry practices, the term, D, is employed to represent a bleaching stage employing chlorine dioxide. Herein, $D_1$ is used to represent the first D stage of a sequence. The term $D_c$, represents a stage employing chlorine dioxide plus chlorine. In such stage, the chlorine may be present in the chlorine dioxide, i.e. a mixture, or the chlorine dioxide may be first added to the pulp and after a brief time period the chlorine is added. The term D→C is at times used to represent this latter chlorine substitution, but herein, the term $D_c$ is deemed to encompass both the mixture and the chlorine substitution procedures unless indicated otherwise.

Following the $D_1$ stage, and with or without an intervening washing, the pulp of the present invention is processed through an ozonation stage, Z. Heretofore, it has been taught in the industry that ozone tends to be decomposed by certain of the heavy metal components of the pulp that conventionally are removed by an additional acid treatment stage that comprises subjecting the pulp to an acidic medium. In the present invention the pulp moves from the $D_1$ stage which is an acidic stage directly to the Z stage with out an acidic treatment stage. In the Z stage, the acid pulp is contacted with ozone in a reaction tower, for example, for a period of time and employing sufficient ozone to effect oxidation of substantial quantities of the chlorinated lignins and/or other chlorinated components of the pulp, in addition to the contribution of the ozone toward further delignification. The quantity of ozone employed is preferably from about 0.3% to about 1.1% based on oven dried pulp. Many of the oxidized chlorine-based moieties are soluble in the environment of the Z stage. Thus, these oxidized chlorine-based moieties are solubilized into the liquor and extracted from the pulp during washing following the Z stage. Other of the oxidized compounds are soluble in an alkaline solution such as is present in an E stage. Extraction with an alkaline medium following the Z stage thus serves to remove alkaline-soluble oxidized chlorine-based moieties from the pulp. As noted, a preferred complete sequence will include an extraction stage following the ozonation stage. Such extraction stage may be enhanced with oxygen, $E_o$, or peroxide, $E_p$, a combination of oxygen and peroxide, $E_{o+p}$, or other enhancer. The pulp may be further processed through any of several selected stages. Preferably, the extraction stage is followed by a further bleaching stage. Chlorine dioxide, i.e. a $D_2$ stage is preferred as such further bleaching stage. As desired, washes may be employed between selected stages, e.g. between the E and $D_2$ stages.

To facilitate a further understanding of the invention, the following examples are given primarily for purposes of illustrating certain more specific details thereof.

Southern softwood kraft pulp with Kappa number of 32.3 and an initial viscosity of 30.3 cP was used as the wood pulp slurry for all of the following Examples except as otherwise noted. The series of Examples used various combinations of the following bleaching stages:

O stage: Prechlorination oxygen delignification was conducted in a reactor for 1 hr. at 85° C., with 3% sodium hydroxide, 40–80 psig oxygen pressure and 0.5% magnesium sulfate on the pulp at a consistency of 10%.

$D_c$ stage: In the sequential chlorine dioxide substitution stage, D→C, chlorine dioxide was added to the pulp and mixed; after 20 seconds, chlorine was added and the pulp was well mixed; this stage was conducted in a reactor for 40 min. at 50° C. with a consistency of 3–10%. In those instances where the chlorine was present in the chlorine dioxide as a mixture, the chlorine was introduced simultaneously with the chlorine dioxide.

C stage: Chlorination was conducted in a reactor for 30 to 40 min. at 45° C. with a consistency of 3%, with chlorine of the desired charge.

D stage: Chlorine dioxide addition was conducted at 50 to 70° C. with a consistency of 10%;

Z stage: The ozone stage was conducted under a pH of about 2–5 at room temperature for 40 to 90 min. with a consistency of 1%; Example 34 was done under alkaline condition at 34% consistency at pH 12.

E stage: Extraction was conducted for 60 min. at 70° C. with a consistency of 10% and with desired sodium hydroxide charge;

$E_o$ stage: Extraction enhanced with oxygen was conducted under conditions similar to the E stage with an initial oxygen pressure of 40–50 psig that was gradually reduced to 0 psig;

$E_p$ stage: Extraction enhanced with peroxide was conducted under conditions similar to the E stage with a 0.4–0.6% hydrogen peroxide charge;

$E_{o+p}$ stage: Extraction enhanced with oxygen and peroxide was conducted under conditions similar to the $E_o$ stage with a 0.4% to 0.6% hydrogen peroxide charge;

Washings: The slurry was washed with distilled water in a screen box or funnel between each stage; the stage labeled (DZ) is a D stage followed immediately by a Z stage without intermediate washing.

EXAMPLES 1–5

Several prior art bleaching sequences employing procedures well known in the art were run on Southern pine softwood kraft pulp having a Kappa number of 32.3. These sequences employed the usual chlorine stages with and without chlorine dioxide substitution. The results are shown in Table I. As expected, good brightness and viscosity values were noted, except when an oxygenation stage was employed prior to chlorination (Example 3). This latter Example showed the deterioration of the pulp (low viscosity) that has been noted in the prior art. Of these Examples, only the D→C $E_{o+p}$DED produced significant reduction in the total chloride on the pulp, but such reduction was obtained only at the expense of two additional stages.

TABLE 1

| Example | Bleaching Sequence | Chemical Charge (% on Oven Dried (OD) Pulp) | Total Chloride on Pulp (ppm)* | Organic Chloride on Pulp (ppm) | Pulp Brightness (GE %) | Pulp Viscosity (cP) | C Factor |
|---|---|---|---|---|---|---|---|
| 1 | D→C$E_{o+p}$D | D→C 1.66–2.9; $E_{o+p}$ 3; D 0.8 | 220 | 190 | 86.1 (83.3)** | 22.5 | 0.22 |
| 2 | D→C$E_{o+p}$DED | D→C 1.66–2.9; $E_{o+p}$ 3; D 0.8; E 0.4; D 0.3 | 195 | 150 | 88.5 (86.5) | 20.8 | 0.22 |
| 3 | OD→C$E_{o+p}$D*** | D→C 1.15–2.9; $E_{o+p}$ 3; D 0.7 | 215 | 170 | 86.8 (84.8) | 14.3 | 0.22 |
| 4 | C$E_o$D | C 7.25; $E_o$ 4.35; D 0.7 | 314 | 300 | 84.7 (80.3) | 23.8 | 0.22 |
| 5 | CEDED | C 7.25; E 4; D 0.7; E 0.5; D 0.5 | 345* | 320 | 86.7 (83.0) | 27.0 | 0.22 |

Remarks:
*Estimated by the sum of inorganic and organic chlorides
**Reverted brightness (at 105° C. for 1 hr).
***Oxygen pulp with kappa number = 22.3, viscosity = 21.8 cP

EXAMPLES 6–13

In Examples 6–13 the pulp employed was the same as in Examples 1–5. Examples 6–13 involved bleaching sequences using an ozone bleaching stage. Table 2 shows the properties of the pulps of these Examples. Employing ozonation prior to chlorination, Examples 6, 7, 10 and 12, produced pulps of low brightness, except in Examples 7 and 12 where additional and costly extraction and chlorine dioxide stages were added. Examples 8 and 9 (DZED) where ozonation was employed after chlorination, produced pulps of good brightness and viscosity plus low total chloride on the pulp. Notably, Examples 8 and 9 (DZED) employed 20% and 7% less chlorine dioxide than Example 11 (DZEDED) plus the fact that the DZED sequence with its fewer stages yielded better viscosity values and almost equal brightness values. Further, the brightness obtained by the DZED sequence is almost equal to the brightness obtained in the more costly prior art CEDED sequence (cf. Ex. 10 and Ex. 5). The DZED (Ex. 8) produced better results than that of ZDED (Ex. 10) at same chemical charge. The DZED produced 84.7% GZ brightness while ZDED produced only 79.0% GZ. The same result has been experienced in the DZEDED (Ex. 11) and ZDEDED (Ex. 12) examples. The DZ sequence also generated less TOCl than that of ZD sequence.

TABLE 2

| Example | Bleaching Sequence | Chemical Charge (% on Oven Dried (OD) Pulp) | Total Chloride on Pulp (ppm) | Organic Chloride on Pulp (ppm) | Pulp Brightness (GE %) | Pulp Viscosity (cP) | C Factor |
|---|---|---|---|---|---|---|---|
| 6 | ZED | $\frac{Z}{2}\frac{E}{2.5}\frac{D}{1.5}$ | ND[1] | ND | 78.9 (N.D.)** | 16.5 | 0 |
| 7 | ZEDED | $\frac{Z}{2}\frac{E}{2.5}\frac{D}{1.5}\frac{E}{0.5}\frac{D}{0.5}$ | 75* | 57 | 87.9 (85.2) | 14.4 | 0 |
| 8 | DZED | $\frac{D}{1.37}\frac{Z}{1.0}\frac{E}{2.5}\frac{D}{0.7}$ | ND | ND | 84.7 (N.D.) | 19.0 | 0.11 |
| 9 | DZED | $\frac{D}{1.4}\frac{Z}{1.0}\frac{E}{2.5}\frac{D}{1.0}$ | 101* | 80 | 86.5 (82.7) | 16.8 | 0.11 |
| 10 | ZDED | $\frac{Z}{1.0}\frac{D}{1.37}\frac{E}{2.5}\frac{D}{0.7}$ | ND | ND | 79.0 (N.D.) | 23.5 | 0.11 |
| 11 | DZEDED | $\frac{D}{1.37}\frac{Z}{1.0}\frac{E}{2.5}\frac{D}{0.7}\frac{E}{0.5}\frac{D}{0.5}$ | 77* | 65 | 89.0 (85.3) | 15.8 | 0.11 |
| 12 | ZDEDED | $\frac{Z}{1.0}\frac{D}{1.37}\frac{E}{2.5}\frac{D}{0.7}\frac{E}{0.5}\frac{D}{0.5}$ | 150* | 140 | 87.2 (84.2) | 21.8 | 0.11 |
| 13 | ODZED | $\frac{D}{1.2}\frac{Z}{0.5}\frac{E}{2.0}\frac{D}{0.7}$ | 99 | 70 | 86.6 (84.0) | 14.4 | 0.14 |

[1]N.D.: not determined.
[2]Kappa NO. of 32.3
*Estimated by the sum of inorganic and organic chlorides.
**Reverted brightness.

EXAMPLES 14–19

Examples 14–16 employed Southern softwood kraft pulp having a Kappa number of 27.3. Table 3 shows certain properties of the resultant bleached pulps. From Table 3 it is noted that enhancement of the extraction stage (e.g. $E_{o,p}$, or $E_{o+p}$ in the DZED bleaching sequence permits the use of less chlorine dioxide in the D stage and produces a pulp of substantially equivalent brightness and viscosity to the pulp produced using a DZED sequence without such enhancement.

Examples 17–19 employed Southern hardwood kraft pulp having a Kappa of 14.9. Table 3 also shows the properties of the resultant bleached pulps of these examples. These pulps showed high viscosity and good brightness values as well as relatively low TOCl values employing total chlorine dioxide amounts less than the total chlorine dioxide amounts employed in obtaining substantially equivalent brightness and viscosity values for softwood pulp. For either softwood or hardwood pulps, the total chlorine dioxide employed in these Examples 14–19 is substantially less than the total chlorine dioxide employed to obtain equivalent brightness and viscosity values without employing ozone after chlorination.

TABLE 3

| Example | Bleaching Sequence | Pulp Kappa No. | C Factor | % Chemical on Pulp | Organic Chloride On Pulp (ppm) | Brightness (% G.E.) | Viscosity (cP) |
|---|---|---|---|---|---|---|---|
| 14 | $DZE_pD$ | 27.3 | 0.12 | $\frac{D}{1.24}\frac{Z}{0.6}\frac{E_p}{3\%\,NaOH}\frac{D}{0.5}$ 0.5% $H_2O_2$ | 110 | 86.3 (ND) | 16.2 |
| 15 | $DZE_oD$ | 27.3 | 0.12 | $\frac{D}{1.24}\frac{Z}{0.6}\frac{E_o}{3}\frac{D}{0.5}$ | 140 | 86.0 (ND) | 16.2 |

TABLE 3-continued

| Example | Bleaching Sequence | Pulp Kappa No. | C Factor | % Chemical on Pulp | Organic Chloride On Pulp (ppm) | Brightness (% G.E.) | Viscosity (cP) |
|---|---|---|---|---|---|---|---|
| 16 | $DZE_{o+p}D$ | 27.3 | 0.12 | $\frac{D}{1.24}\ \frac{Z}{0.6}\ \frac{E_{o+p}}{3\%\ NaOH}\ \frac{D}{0.5}$ 0.5% $H_2O_2$ | 110 | 87.0 (ND) | 14.7 |
| 17 | $DZE_oD$ | 14.9 | 0.12 | $\frac{D}{0.7}\ \frac{Z}{0.4}\ \frac{E_o}{1.5}\ \frac{D}{0.6}$ | 120 | 85.9 (82.1) | 18.6 |
| 18 | $DZE_pD$ | 14.9 | 0.12 | $\frac{D}{0.7}\ \frac{Z}{0.4}\ \frac{E_p}{1.5}\ \frac{D}{0.6}$ | 130 | 85.8 (81.7) | 18.8 |
| 19 | $DZE_{o+p}D$ | 14.9 | 0.12 | $\frac{D}{0.7}\ \frac{Z}{0.4}\ \frac{E_{o+p}}{1.5}\ \frac{D}{0.6}$ | 120 | 86.5 (82.1) | 18.6 |

EXAMPLES 20–54

A laboratory $D_cZED$ bleaching sequence was studied using a central composite statistically designed experiment which varied $D_c$ stage chlorination factor and fraction of chlorine dioxide charge, and ozone charge in the Z stage. The pulp had a Kappa number of 32.3. The results are shown in Table 4. In Table 4, Examples 24, 29–32, 34, 38–41, 45, 47–49 and 54 represent actual run data which served as the basis for the statistically designed experimental data of the remaining examples. From this data it may be concluded that to obtain a pulp brightness of about 85% GE or higher and a viscosity of at least about 18 cP, the preferred chlorination factor is about 0.12 and the ozone charge is about 1.1%. This holds true for chlorine dioxide which includes up to about 20% chlorine. All of the pulps of Examples 20–38 showed low TOCl and AOX values, each being within present regulatory limits. Most surprisingly, however, it was found that by using a lower chlorination factor (e.g. 0.12) which results in substantial savings in the cost of chlorine-based bleaching agent, one can use ozone percentages of about 1% and obtain a three-fold reduction in AOX values.

TABLE 4[3]

| Example | Bleaching Sequence | C Factor[1] | $ClO_2$ (%) | % Charge (% on oven dried (OD) pulp) D[4] | C[4] | Z | D[2] | Total Organic C1 on pulp (ppm) | AOX Total (kg/BDT) | Pulp Brightness (% GE) | Viscosity (cP) |
|---|---|---|---|---|---|---|---|---|---|---|---|
| 20 | DZED | 0.037 | 100 | 1.20 | 0.00 | 0.9 | 1.0 | 60 | 0.1 | 55.0 | 23.5 |
| 21 | $D_cZED$ | | 95 | 1.14 | 0.06 | 1.0 | 1.0 | 40 | 0.1 | 58.0 | 22.2 |
| 22 | $D_cZED$ | | 90 | 1.08 | 0.12 | 1.0 | 1.0 | 65 | 0.1 | 59.0 | 22.0 |
| 23 | $D_cZED$ | | 80 | 0.96 | 0.24 | 1.1 | 1.0 | 50 | 0.2 | 62.0 | 21.0 |
| 24 | $D_cZED$ | | 50 | 0.60 | 0.60 | 0.8 | 1.0 | 360 | 0.5 | 47.0 | 21.8 |
| 25 | DZED | 0.07 | 100 | 2.26 | 0.00 | 1.2 | 1.0 | 20 | 0.2 | 76.0 | 20.2 |
| 26 | $D_cZED$ | | 95 | 2.14 | 0.12 | 1.3 | 1.0 | 20 | 0.2 | 80.0 | 20.0 |
| 27 | $D_cZED$ | | 90 | 2.03 | 0.23 | 1.3 | 1.0 | 50 | 0.3 | 79.0 | 19.5 |
| 28 | $D_cZED$ | | 80 | 1.81 | 0.45 | 1.3 | 1.0 | 100 | 0.4 | 78.0 | 19.0 |
| 29 | $D_cZED$ | | 80 | 1.81 | 0.45 | 1.0 | 1.0 | 240 | 0.6 | 65.1 | 20.1 |
| 30 | $D_cZED$ | | 80 | 1.81 | 0.45 | 0.5 | 1.0 | 440 | 0.4 | 46.5 | 25.7 |
| 31 | $D_cZED$ | | 20 | 0.45 | 1.81 | 0.5 | 1.0 | 725 | 1.8 | 43.8 | 23.8 |
| 32 | $D_cZED$ | | 20 | 0.45 | 1.81 | 1.1 | 1.0 | 220 | 1.5 | 63.0 | 18.8 |
| 33 | DZED | 0.12 | 100 | 3.88 | 0.00 | 1.1 | 1.0 | 100 | 0.4 | 85.0 | 18.6 |
| 34 | DZED | | 100 | 3.88 | 0.00 | 0.8 | 1.0 | 170 | 0.7 | 79.6 | 21.9 |
| 35 | $D_cZED$ | | 95 | 3.67 | 0.19 | 1.1 | 1.0 | 125 | 0.5 | 85.0 | 18.5 |
| 36 | $D_cZED$ | | 90 | 3.49 | 0.39 | 1.1 | 1.0 | 150 | 0.6 | 84.0 | 18.0 |
| 37 | $D_cZED$ | | 80 | 3.10 | 0.78 | 1.1 | 1.0 | 200 | 0.8 | 83.0 | 17.8 |
| 38 | $D_cZED$ | | 50 | 1.94 | 1.94 | 0.3 | 1.0 | 370 | 3.0 | 72.7 | 18.6 |
| 39 | $D_cZED$ | | 50 | 1.94 | 1.94 | 0.8 | 1.0 | 380 | 2.7 | 72.3 | 18.9 |
| 40 | $D_cZED$ | | 50 | 1.94 | 1.94 | 1.3 | 1.0 | 255 | 2.3 | 84.7 | 15.9 |
| 41 | $D_cZED$ | | 0 | 0.00 | 3.88 | 0.8 | 1.0 | 440 | 4.4 | 67.4 | 17.4 |
| 42 | DZED | 0.17 | 100 | 5.50 | 0.00 | 0.7 | 1.0 | 100 | 0.9 | 87.5 | 20.2 |
| 43 | $D_cZED$ | | 95 | 5.22 | 0.28 | 0.7 | 1.0 | 125 | 1.0 | 87.5 | 20.0 |
| 44 | $D_cZED$ | | 90 | 4.95 | 0.55 | 0.7 | 1.0 | 150 | 1.2 | 87.0 | 19.5 |
| 45 | $D_cZED$ | | 80 | 4.40 | 1.10 | 1.1 | 1.0 | 170 | 2.5 | 88.1 | 15.8 |
| 46 | $D_cZED$ | | 80 | 4.40 | 1.10 | 0.7 | 1.0 | 200 | 1.4 | 86.0 | 19.1 |
| 47 | $D_cZED$ | | 80 | 4.40 | 1.10 | 0.5 | 1.0 | 280 | 3.2 | 84.2 | 21.4 |
| 48 | $D_cZED$ | | 20 | 1.10 | 4.40 | 1.1 | 1.0 | 250 | 6.9 | 86.3 | 14.9 |
| 49 | $D_cZED$ | | 20 | 1.10 | 4.40 | 0.5 | 1.0 | 380 | 5.9 | 76.9 | 19.8 |
| 50 | DZED | 0.20 | 100 | 6.46 | 0.00 | 0.3 | 1.0 | 95 | 1.3 | 88.0 | 25.2 |
| 51 | $D_cZED$ | | 95 | 6.14 | 0.32 | 0.3 | 1.0 | 125 | 1.5 | 88.0 | 24.8 |

TABLE 4(3)-continued

| Example | Bleaching Sequence | C Factor(1) | $ClO_2$ (%) | % Charge (% on oven dried (OD) pulp) D(4) | C(4) | Z | D(2) | Total Organic C1 on pulp (ppm) | AOX Total (kg/BDT) | Pulp Brightness (% GE) | Viscosity (cP) |
|---|---|---|---|---|---|---|---|---|---|---|---|
| 52 | $D_cZED$ | | 90 | 5.81 | 0.65 | 0.3 | 1.0 | 150 | 1.8 | 87.5 | 24.6 |
| 53 | $D_cZED$ | | 80 | 5.17 | 1.29 | 0.3 | 1.0 | 200 | 2.0 | 87.0 | 24.2 |
| 54 | $D_cZED$ | | 50 | 3.23 | 3.23 | 0.8 | 1.0 | 215 | 5.7 | 88.8 | 15.5 |

(1) Kappa number of 32.3.
(2) Preceded by an alkaline extraction with 3% sodium hydroxide charge.
(3) Based on predicted data, except examples 24, 29–32, 34, 38–41, 45, 47–49 and 54.
(4) Based on effective chlorine Table 5 shows the adsorbed organic halogens (AOX) generated in the bleaching stages of the sequences of Examples 1–3, 9, 11 and 14. Examples 1 and 2 showed AOX levels in excess of the desired 2.0 kg per ton of wood pulp. A pre-delignification stage, as in Example 3, produced effluent within the 2.0 kg level, but Example 3 had high levels of chloride in the wood pulp (see Table 2). Examples 9, 11 and 14 involved stages of chlorine dioxide bleaching followed by ozonation. Example 9 represented a DZED sequence, and produced effluent well below the targeted AOX level. Example 14 showed that pre-delignification with oxygen can improve the AOX level, but at the expense of the cost associated with the additional stage (O).

TABLE 5

| Example | Sequence | AOX (kg/BDT) in Effluent stages | Total |
|---|---|---|---|
| 1 | $D \rightarrow CE_{o+p}D$ | $\frac{D \rightarrow C}{0.86}\ \frac{E_{o+p}}{1.3}\ \frac{D}{0.04}$ | 2.20 |
| 2 | $D \rightarrow CE_{o+p}DED$ | $\frac{D \rightarrow C}{0.86}\ \frac{E_{o+p}}{1.3}\ \frac{D}{0.04}\ \frac{E}{0.02}\ \frac{D}{0.01}$ | 2.23 |
| 3 | $OD \rightarrow CE_{o+p}D$ | $\frac{D \rightarrow C}{0.71}\ \frac{E_{o+p}}{0.5}\ \frac{D}{0.06}$ | 1.27 |
| 9 | DZED | $\frac{D}{0.13}\ \frac{Z}{0.2}\ \frac{E}{0.06}\ \frac{D}{0.04}$ | 0.43 |
| 11 | DZEDED | $\frac{D}{0.13}\ \frac{Z}{0.2}\ \frac{E}{0.06}\ \frac{D}{0.04}\ \frac{E}{0.1}\ \frac{D}{0.1}$ | 0.63 |
| 14 | ODZED | $\frac{D}{0.17}\ \frac{Z}{0.09}\ \frac{E}{0.04}\ \frac{D}{0.02}$ | 0.32 |

Figure 4:
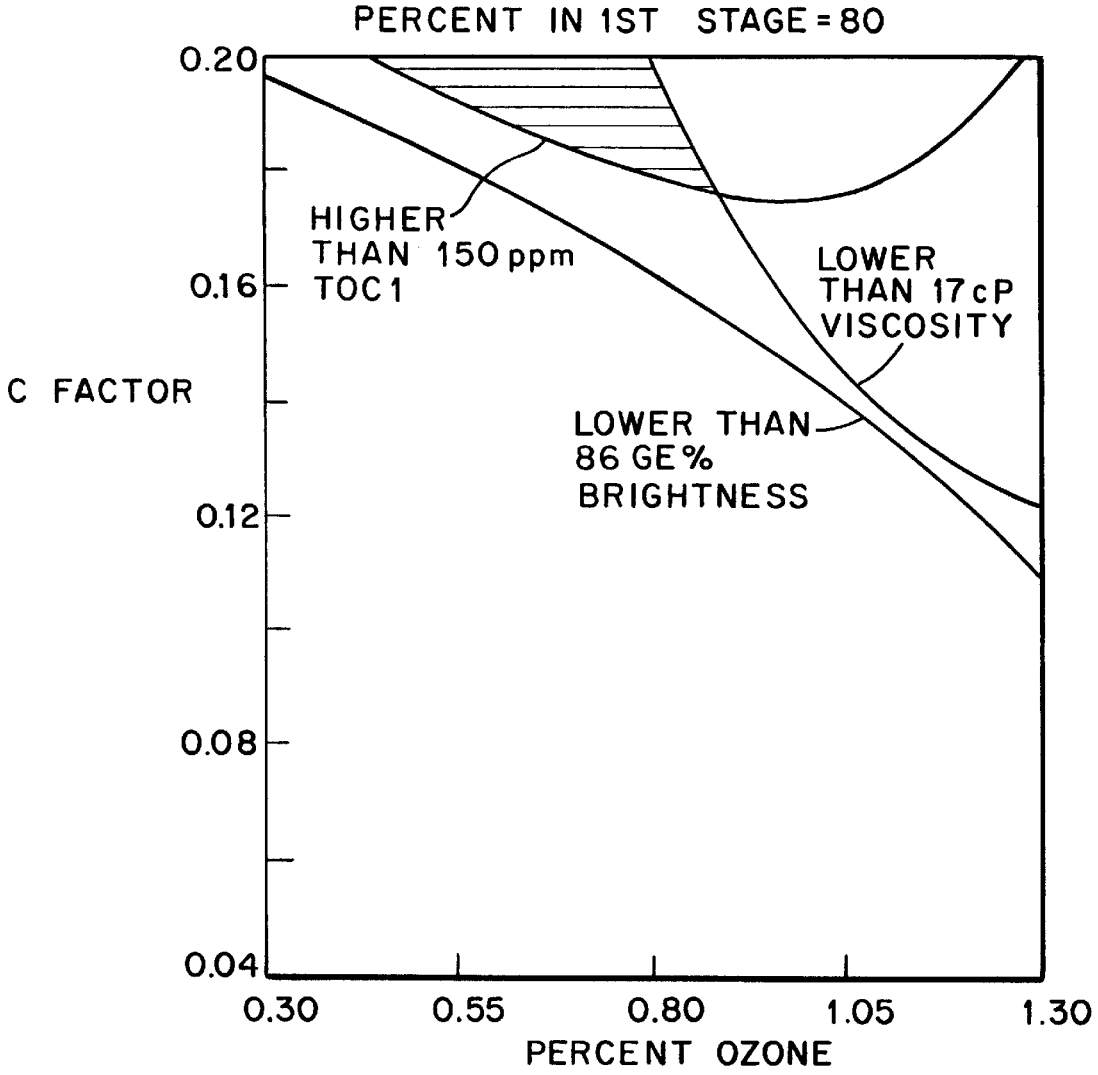
Figure 5:
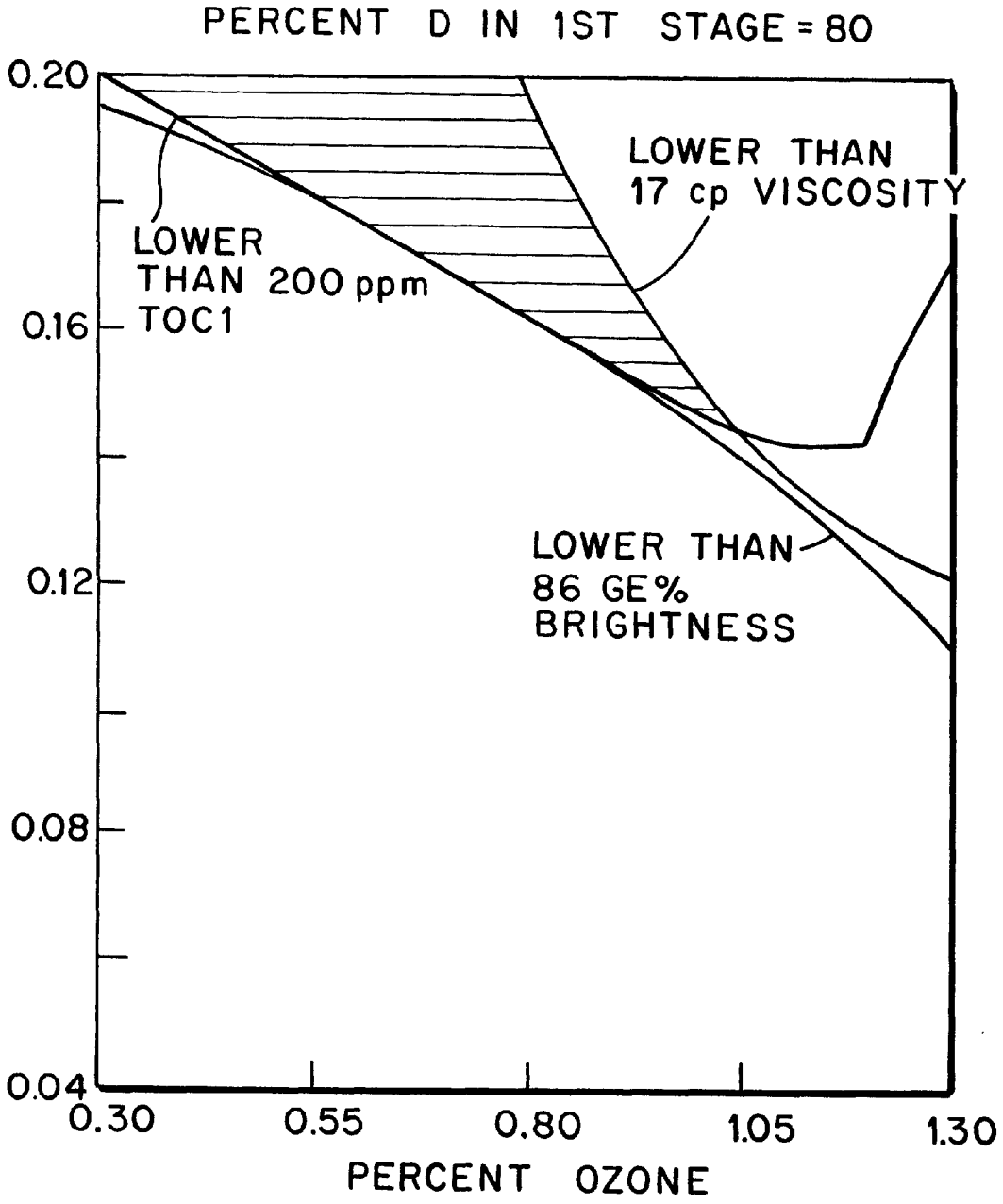

Experimental data were subjected to regression analysis of pulp brightness, viscosity and TOCl on chlorination factor, fraction of chlorine dioxide charge in the $D_c$ stage and ozone charge in the second stage ($D_cZED$ sequence). The results are depicted graphically in FIGS. 1–5. From these Figures, at 100% chlorine dioxide in the $D_c$ stage, it may be seen that as one accepts a lower viscosity, equal amounts of ozone can be employed with lower quantities of chlorine dioxide ("C" factor) while still maintaining high brightness and low TOCl values. This relationship holds true when the chlorine dioxide charge includes up to 20% chlorine (see FIGS. 4 and 5), the actual ranges being somewhat condensed when employing an 80/20 mixture of chlorine dioxide and chlorine.

It may be seen from the foregoing that the present invention provides for a method of preparation of kraft cellulosic wood pulp fibers for use in papermaking that reduces the total chloride residue in the wood pulp to less than 200 ppm and the AOX discharge per ton of wood pulp to less than 2.0 kg. In addition, the wood pulp has a brightness greater than 85% GE and a viscosity above about 14 centipoises. Also, the method is economical and readily adaptable to the current papermaking industry.

From the Examples, it will be noted that the percentage of ozone, based on oven dry weight of pulp, employed varies as a function of the "C" factor, the effective ratio of "C." factor to % ozone being between about 0.11 and 0.6, and preferably between about 0.2 and 0.6 for minimizing the TOCl and AOX values while maximizing the brightness and viscosity values of the pulp.

EXAMPLES 55–58

In Table 6, there are shown the results of two runs in which the dioxin content of the pulp and effluent was determined. Southern pine kraft pulp, with 1% reject from cooking, having a Kappa No. of 30.3 and a viscosity of 35 cP was employed in all examples. In Example 55, a control run indicative of prior art bleaching sequences that do not employ ozone, but which do include oxygen and peroxide enhanced extraction, there was no detectable tetrachlorodibenzodioxin (TCDD) in the final bleached pulp. In this example, there was detected 2.5 ppt of tetrachlorodibenzofuran (TCDF). In the effluent from this run there was detected 2.5 ppt and 30.3 ppt of TCDD and TCDF, respectively, In Example 58, a $D_cZE_oD$ sequence in accordance with the present invention, there were no dioxins (TCDD or TCDF) detected in either the pulp or the effluent.

TABLE 6

DETERMINATION OF DIOXINS

| Example | Bleaching Sequences | Conditions | | | | Brightness (% GE) | AOX (kg/TP) | ToCl (ppm) | | Dioxins (unit = ppt on pulp) TCDD | TCDF |
|---|---|---|---|---|---|---|---|---|---|---|---|
| 55 | $D \rightarrow CE_{o+p}D$ | D → C | | $E_{o+p}$ | D | 86.5 (81.0) | 2.78 | 210 | Pulp | ND | 2.5 |
| | | 1.53%→2.67% | | 3% NaOH 0.4% $H_2O_2$ | 0.8% | | | | Effluent | 2.5 | 30.3 |
| 56 | $DE_oDP$ | D | $E_o$ | D | P | 85.0 (82.4) | 0.90 | 200 | Pulp | ND | 1.762 |
| | | 2.08% | 2% | 0.8% | 0.57% | | | | | | |
| 57 | $DZE_oD$ | D | | Z | $E_o$ D | 85.3 (80.0) | 0.49 | 100 | Pulp | ND | ND |
| | | 1.27% | | 1.0% | 2% 0.8% | | | | Effluent | ND | ND |
| 58 | $D_cZED$ | D | | Z | E D | 83.0 | 1.35 | 200 | Pulp | ND | ND |
| | | 1.0%→0.71% | | 1.0% | 2.5% 0.8% | | | | Effluent | ND | ND |

Remarks

1. First chlorination stage was conducted at 45° C. for 30 minutes.
2. Eo, $E_{o+p}$ was conducted in Quantum Reactor at 10% CSC, 75° C. for 1 hours at 45 psig $O_2$ pressure, gradually reduced to 0 psig.
3. Final D stage was conducted at 10% CSC, 70° C. for 2.5 hours.
4. Not detectable.

EXAMPLE 59

Table 7 presents the results of a bleaching sequence in accordance with the present invention in which the ozonated pulp at a pH of 12.7 was processed directly to an alkaline extraction stage (enhanced with oxygen) without an intervening water washing ($ZE_o$). In this Example 59, the GE brightness of the pulp and its viscosity were lower than when the pulp was washed with water between the Z and E stages, but these parameter values were still in a range that is acceptable for certain pulps. The simplification of this process can lead to a capital reduction. The TOCl of the pulp was 128 ppm, well below present regulated standards.

TABLE 7

DZED SEQUENCE UNDER ALKALINE OZONATION CONDITIONS

| Example | Sequence | Conditions D | Z | $E_o$ | D | Brightness % GE | Viscosity cP | TOCl ppm |
|---|---|---|---|---|---|---|---|---|
| 59 | $D(ZE_o)D$ | 1.15% | 3% NaOH 34% consistency | 3% | 0.8% | 81.3 (77.5) | 11 | 128 |

What is claimed is:

1. A method for the treatment of kraft pulp in preparation for its use in papermaking comprising the steps of:

contacting said pulp while dispersed in an aqueous medium with an initial charge of a chlorine-based bleaching agent selected from the group consisting of chlorine dioxide, and mixtures of chlorine dioxide and chlorine, wherein the total chlorine dioxide present in said charge represents between about 100% and about 50% of the total charge, expressed as effective chlorine, the remainder of said charge being chlorine, said bleaching agent producing a substantial quantity of chlorine-containing moieties that are insoluble in an acid medium, thereafter, and prior to any intervening treatment of said pulp other than a wash, contacting said pulp with ozone, said ozone being present in an amount which provides a ratio of "C" factor to % ozone, based on dry weight of pulp, from about 0.036 to about 0.7 for a period of time sufficient to cause said ozone to oxidize substantial quantities of said chlorine-containing moieties and render the same soluble in the acid medium of said pulp, thereafter, separating said solubilized chlorine-containing moieties from said pulp, and whereby there is obtained a pulp having substantially lower chlorine content, essentially no 2, 3, 7, 8 tetrachlorodibenzodioxin, essentially no 2, 3, 7, 8 tetrachlorodibenzofuran, and substantially equivalent brightness and viscosity as the same pulp which has been bleached employing conventional chlorine-based bleaching sequences.

2. The method of claim 1 wherein said separation of said solubilized chlorine-containing moieties from said pulp comprises washing said pulp with an aqueous medium.

3. The method of claim 2 and including the further and subsequent treatment of said washed pulp with an alkaline extraction.

4. The method of claim 3 including the step of enhancing said extraction by the addition of oxygen, peroxide or a combination thereof.

5. The method of claim 3 and including the further and subsequent treatment of said pulp with chlorine dioxide.

6. The method of claim 1 wherein the total quantity of chlorine dioxide and/or chlorine applied to said pulp is sufficient to provide a "C" factor of greater than about 0.04 and less than about 0.20, based on oven dried pulp.

7. A bleaching sequence for kraft pulp consisting of the stages of $D_cZED$ in that order with no other stares either before, in-between or following the stages of this sequence other than washing stages.

* * * * *

UNITED STATES PATENT AND TRADEMARK OFFICE

CERTIFICATE OF CORRECTION

PATENT NO. : 6,153,051
DATED : November 28, 2000
INVENTOR(S) : Ted Yuan Tsai

It is certified that error appears in the above-identified patent and that said Letters Patent is hereby corrected as shown below:

Column 5 and 6, Table 1,
Example 3, after "OD→CE $_{o+p}$ D***" in the next column underneath "D→C" delete "1.15---2.9" and insert -- 1.15---2 --

Column 12,
Line 36, after "ratio of" delete "C." and insert -- "C"

Column 13 and 14,
Table 6 in the heading, delete "ToC1" and insert -- TOC1 --

Column 13,
Line 27, after "for 1" delete "hours" and insert -- hour --

Column 15,
Claim 7 after "no other" delete "stares" and insert -- stages --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*